United States Patent [19]

Matsuda et al.

[11] 4,114,572

[45] Sep. 19, 1978

[54] FUEL-AIR MIXTURE FEED DEVICE OF THE MULTIPLE CYLINDER AND MULTIPLE CARBURETOR TYPE FOR AN INTERNAL COMBUSTION ENGINE

[75] Inventors: Munekazu Matsuda, Nishinomiya; Yoshiaki Sakaue, Akashi, both of Japan

[73] Assignee: Kawasaki Jukogyo Kabushiki Kaisha, Japan

[21] Appl. No.: 728,205

[22] Filed: Sep. 30, 1976

[30] Foreign Application Priority Data

Oct. 4, 1975 [JP] Japan ..... 50/120195

[51] Int. Cl.[2] ..... F02M 13/04

[52] U.S. Cl. ..... 123/59 PC; 123/52 M; 123/127

[58] Field of Search ..... 123/59 PC, 52 M, 127

[56] References Cited

U.S. PATENT DOCUMENTS

| | | | |
|---|---|---|---|
| 2,713,333 | 7/1955 | Burrell et al. | 123/127 X |
| 3,742,922 | 7/1973 | Hisatomi et al. | 123/59 PC |

*Primary Examiner*—Wendell E. Burns

*Attorney, Agent, or Firm*—McGlew and Tuttle

[57] ABSTRACT

A fuel-air mixture feed device for use with a multiple cylinder internal combustion engine having at least one carburetor for high loads, and at least one carburetor for high and low loads, comprising main conduits connecting the cylinders to the carburetors and at least one branch conduit connecting the main conduits to each other. By this arrangement, the carburetor for high loads is rendered inoperative at low loads and the carburetor for high and low loads is operated to feed fuel-air mixtures to the cylinders, while all the carburetors are operated at high loads so that maximum power can be obtained at all time.

1 Claim, 5 Drawing Figures

FUEL-AIR MIXTURE FEED DEVICE OF THE MULTIPLE CYLINDER AND MULTIPLE CARBURETOR TYPE FOR AN INTERNAL COMBUSTION ENGINE

BACKGROUND OF THE INVENTION

This invention relates to fuel-air mixture feed devices for use with multiple cylinder and multiple carburetor type for motor vehicles, and more particularly to a fuel-air mixture feed device of the type described adapted for use with a motorcycle.

In an engine of high power per unit swept volume, it is necessary to increase suction efficiency and the throat diameter of the Venturi pipe so as to supply a large volume of air to the cylinder of the engine. However, an increase in the throat diameter of the Venturi tube leads to a disadvantage wherein vaporization of the fuel is not carried out satisfactorily at low loads, because the flow velocity of the air passing through the Venturi is reduced and the negative pressure of the air intake does not reach a sufficiently high level to obtain satisfactory atomization of the fuel.

In the case of a fuel-air mixture feed device of the multiple cylinder and single carburetor type which is generally in use in four-wheeled motor vehicles, all the cylinders are interconnected by means of a manifold. This arrangement enables negative pressure of air intake to be increased by the synergystic effect of the negative pressure of air intake into each cylinder, with the result that the performance of the engine at low loads is improved as compared with an engine of the type having a carburetor for each cylinder. However, if this construction is incorporated in a motorcycle engine, it will lead to a reduction in maximum power of the engine due to the facts that a resistance is offered to the air by the elongated manifold and that a sufficiently large volume of suction air to obtain the required air-fuel ratio is unobtainable in the case of a single carburetor engine.

In order to obviate this disadvantage, proposals have been made to use a compound carburetor, mainly with fuel-air mixture feed devices of four-wheeled motor vehicles, which comprises two carburetor bores, one carburetor bore having a smaller Venturi throat diameter and the other carburetor bore having a larger Venturi throat diameter, the carburetor bore of the smaller Venturi throat diameter alone being rendered operative at low loads and the two carburetor bores of the smaller and larger Venturi throat diameters both being rendered operative at high loads. However, the use of this compound carburetor in a fuel-air mixture feed device of the multiple cylinder and multiple carburetor type will have disadvantages in that the carburetor assembly as a whole becomes large in size and the conjointly operating mechanism for the carburetors will become complex in construction. Particularly when the compound carburetors are incorporated in a motorcycle of the multicylinder engine, difficulty will be encountered in designing the mounting of the engine on the motorcycle due to the aforesaid disadvantages.

SUMMARY OF THE INVENTION

Keeping in mind the aforementioned problems and the proposals made to solve such problems, an object of this invention is to provide a fuel-air mixture feed device for use with multiple cylinder and multiple carburetor type for an internal combustion engine which is simple in construction and adapted to be mounted on a motorcycle.

Another object of the invention is to provide a fuel-air mixture feed device for use with multiple cylinder and multiple carburetor type wherein one or two carburetors are rendered operative at low loads to feed fuel-air mixtures to the associated cylinders by means of a suitable manifold arrangement and the negative pressure in the suction conduits is raised by utilizing the synergystic effect of the negative pressure of suction air in all the cylinders so as to obtain a stabilized performance of the engine at low loads, and wherein all the carburetors are rendered operative at high loads so as to obtain a maximum power.

According to the invention, there is provided a fuel-air mixture feed device for use with multiple cylinder and multiple carburetor type for an internal combustion engine comprising: at least one carburetor for high loads; at least one carburetor for high and low loads; suction conduit means including a plurality of main conduits and at least one branch conduit, said main conduits being the same in number as a plurality of cylinders of the engine, each of said plurality of main conduits connecting one of said plurality of cylinders to one of said carburetors, and said at least one branch conduit being the same in number as said at least one carburetor for high loads and connecting the adjacent two main conduits to each other.

DESCRIPTION OF THE PREFERRED EMBODIMENTS

Figure 1:
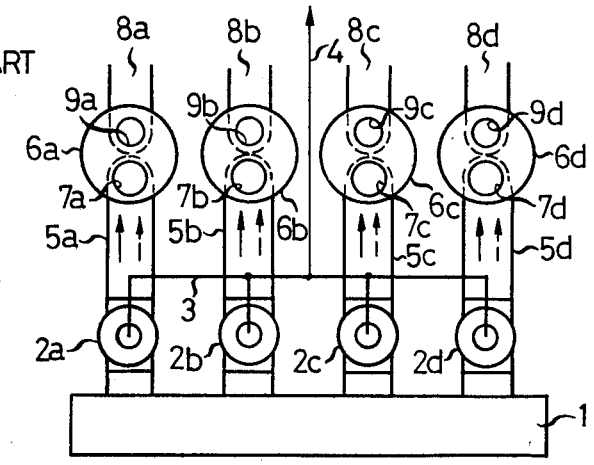
FIG.1 PRIOR ART
FIG. 1 is a schematic plan view of a fuel-air mixture feed device of the four cylinder and four carburetor type of the prior art.

Before describing in detail the present invention with reference to the embodiments shown in the accompanying drawings, a fuel-air mixture feed device of the prior art for an internal combustion engine having four carburetors each associated with one of four cylinders will be described. The numeral 1 designates an air cleaner which is used in common. The numerals 2*a* to 2*d* designate carburetors of a simple construction each having a Venturi tube of a variable throat diameter. Designated by the numeral 3 is a lever mechanism for simultaneously operating throat diameter varying means such as pistons (not shown) of the carburetors 2*a* to 2*d* of the variable throat diameter Venturi type, the lever mechanism 3 being connected to a pedal or grip (not shown) through a link mechanism 4.

Designated by the numerals 5*a* to 5*d* are suction or intake which connect suction valves 7*a* to 7*d* of the cylinders 6a to 6d to the carburetors 2a to 2d respectively. The numerals 8a to 8d designate exhaust pipes, and the numerals 9a to 9d exhaust valves.

In operation, the throat diameter of the Venturi tube of each of the carburetors 2a to 2d is varied at low and high loads. The cylinder 6a is first ignited and then the cylinders 6b, 6c and 6d are ignited successively in the indicated order. Thus the cylinders 6a to 6d operate in suction or intake stroke in the indicated order. When each of the cylinders 6a to 6d is in its suction or intake stroke position, air flows only to the carburetor which is associated with the cylinder in the suction or intake stroke position, and the flow of air to other cylinders is interrupted. Thus the atmospheric pressure prevails in other suction or intake conduits than the suction or intake conduit which is in its suction or intake stroke position.

Figure 2:
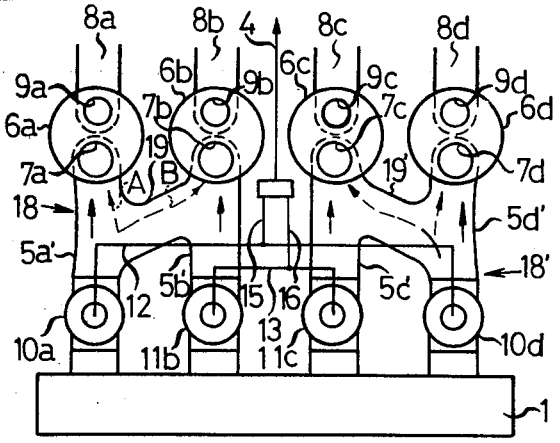
FIG. 2 is a schematic plan view of the fuel-air mixture feed device for use with multiple cylinder and multiple carburetor type comprising one embodiment of the invention.

FIG. 2 to FIG. 5 show preferred embodiments of the invention which will now be described in detail. In FIG. 2, there is shown one embodiment of the invention wherein the throat diameter of the Venturi pipe of each carburetor can be varied by means of a throat diameter varying means such as a piston (not shown). There are shown carburetors 10a, 11b, 11c and 10d as seen from left to right in the figure, each having a Venturi tube of the variable throat diameter. Of these carburetors, the variable throat diameter Venturi carburetors 10a and 11b form one group or left group, while the variable throat diameter Venturi type carburetors 11c and 10d form another group or right group. Cylinders 6a and 6b form one group or left group, while cylinders 6c and 6d form another group or right group.

One carburetor 10a of the carburetors of the left group 10a and 11b and one carburetor 10d of the carburetors of the right group 11c and 10d are carburetors for high and low loads which are adapted to feed fuel-air mixtures to the cylinders at both low and high loads. The other carburetor 11b (11c) of each carburetor group is a high load carburetor which is adapted to feed fuel-air mixtures to the cylinders at high loads or at loads near high loads. Thus the carburetors 10a, 11b, 11c and 10d are adjusted such that they operate as aforementioned.

The throat diameter varying means of the carburetors 10a and 10d for both high and low loads are connected to each other by a coupling lever 12, while the throat diameter varying means of the carburetors 11b and 11c for high loads are connected to each other by another coupling lever 13. The coupling levers 12 and 13 are operated in association with each other by means of links 15 and 16 and a conjointly operating mechanism 17. The numeral 4 designates a link mechanism.

The cylinders 6a and 6b of the left group communicate with the carburetors 10a and 11b of the left group through a suction conduit means 18 substantially in the form of a letter N reversed in a horizontal plane. The suction conduit means 18 comprises rectilinear main conduit 5a' which connects the carburetor 10a to the cylinder 6a, and a rectilinear main conduit 5b' which connects the carburetor 11b to the cylinder 6b. The two rectilinear main conduits 5a' and 5b' communicate with each other through a branch conduit 19 which diverts from a point at the rectilinear main conduit 5a' near the carburetor 10a and extends in a gentle glope toward the cylinder 6b as shown in FIG. 2.

The cylinder 6c and 6d of the right group communicate with the carburetors 11c and 10d of the right group in the same manner as described with reference to the carburetors and cylinders of the left group. More specifically, they communicate with each other through a suction conduit means 18' which is substantially in the form of a letter N and which includes a rectilinear main conduit 5c' connecting the carburetor 11c to the cylinder 6c and a rectilinear main conduit 5d' connecting the carburetor 10d to the cylinder 6d. A branch conduit 19' diverts from a point at the rectilinear main conduit 5d' near the carburetor 10d and extends in a gently slope toward the cylinder 6c as shown in FIG. 2.

Figure 3:
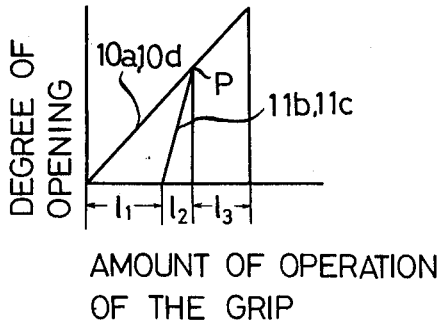
FIG. 3 is a graph showing the relation between the Venturi throat diameter of the carburetors shown in FIG. 2 and the amount of operation of the grip.

The conjointly operating mechanism 17, which comprises two cams (not shown) differing from each other in the shape of the crest and levers actuated by the cams, is set such that the degree of opening of each carburetor undergoes a change as shown in FIG. 3. Referring to FIG. 3, the throat diameter of the Venturi tube of each of the carburetors 10a, 10d for high and low loads increases in proportion to the amount of operation of the grip in a low load range $l_1$ including idling. Then, in an intermediate load range $l_2$ in which the power of the engine has increased, the throat diameter of the Venturi tube of each of the carburetors 11b and 11c for high loads abruptly increases as the grip is operated, until the Venturi tubes of all the carburetors have the same throat diameter at a point P. In a high load range $l_3$ which follows the intermediate load range $l_2$, the throat diameter of the Venturi tubes of all the carburetors is increased until the Venturi tube is fully open in accordance with the amount of operation of the grip.

If the cylinder 6a is brought to a suction stroke position, the negative pressure in the cylinder 6a will cause air flow to the carburetor 10a for high and low loads, with the result that a fuel-air mixture is supplied through the rectilinear main conduit 5a' of the suction conduit means 18 to the cylinder 6a as indicated by a broken line arrow A. Then the cylinder 6a moves on to the next following stroke position, and the negative pressure in the suction conduit means 18 is reduced and the prevailing pressure rises to a level which is substantially near the atmospheric pressure. However, the other cylinder 6b of the same group is brought to a suction stroke position while a negative pressure still remains in the suction conduit means 18, so that the negative pressure in the suction conduit means 18 is increased again. This causes a fuel-air mixture to flow from the carburetor 10a for high and low loads through the branch conduit 19 as indicated by a broken line arrow B to the cylinder 6b.

Then the cylinder 6d of another group is brought to a suction stroke position, and thereafter the cylinder 6c of the same group as the cylinder 6d is brought to a suction stroke position, so that a fuel-air mixture is delivered to the cylinders 6d and 6c from the carburetor 10d for high and low loads of the same group. According to the invention, the negative pressure in the suction conduit means is increased to thereby stabilize the performance of the engine at low engine loads. Moreover, little resistance is also offered to the flow of fuel-air mixtures passing through the branch conduits because the latter tilt gently in a horizontal plane. These features are conducive to increased efficiency in delivering fuel-air mixtures to the cylinders.

At high loads, the throat diameter of the Venturi tube of each of the carburetors 11b and 11c of the different groups for high loads is increased, so that fuel-air mixtures are delivered from the carburetors to the associated cylinders 6a, 6b, 6c and 6d through the rectilinear paths as indicated by solid line arrows. Little resistance is offered to the flow of fuel-air mixtures passing through the rectilinear main conduits of the suction conduit means.

Figure 4:
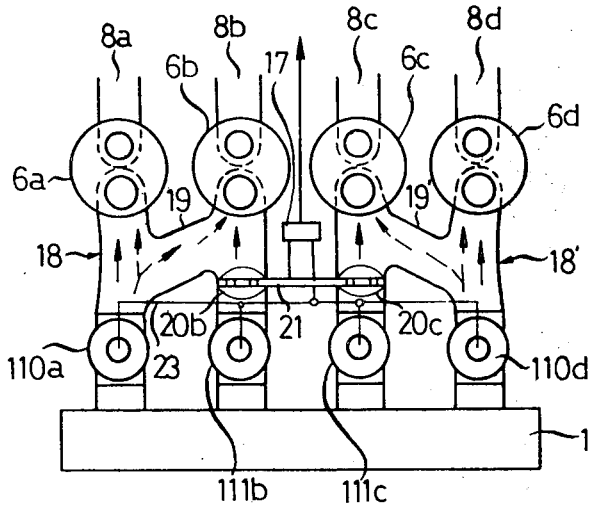
FIG. 4 is a schematic plan view of the fuel-air mixture feed device for use with multiple cylinder and multiple carburetor type comprising another embodiment of the invention.

FIG. 4 shows another embodiment of the invention which comprises an actuation lever 23 which is connected to all the carburetors 110*a*, 111*b*, 111*c* and 110*d* of the two groups, butterfly valves 20*b* and 20*c* mounted in rectilinear main conduits extending from the carburetors 111*b* and 111*c* of the different groups, respectively, and a coupling lever 21 for the butterfly valves 20*b* and 20*c*. The throat diameter of the Venturi pipe of each carburetor 110*a*, 111*b*, 111*c* or 110*d* can be varied by means of a throat diameter varying means such as a piston (not shown). The coupling lever 21 for the butterfly valves 20*b* and 20*c* and the actuation lever 23 for all the carburetors 110*a*, 111*b*, 111*c* and 110*d* are operated in conjunction with each other by the conjointly operating mechanism 17.

In operation, the butterfly valves 20*b* and 20*c* are fully closed at low loads, while the throat diameter of the Venturi tube of each of the carburetors 110*a*, 111*b*, 111*c* and 110*d* is increased and the butterfly valves 20*b* and 20*c* are fully open at high loads. Thus, the inwardly disposed carburetors 111*b* and 111*c* can be made to function in such a manner that their operation characteristic is essentially similar to that of the carburetors 11*b* and 11*c* for high loads shown in FIG. 2. The features of this embodiment make it possible to adjust all the carburetors to the same operating condition because the carburetors 110*a*, 111*b*, 111*c* and 110*d* are operated by means of the common actuation lever 23.

Figure 5:
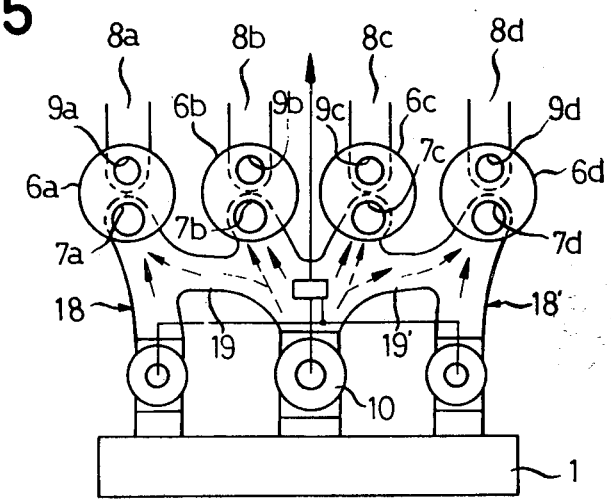
FIG. 5 is a schematic plan view of the fuel-air mixture feed device for use with multiple cylinder and multiple carburetor type comprising still another embodiment of the invention.

FIG. 5 shows still another embodiment wherein the cylinders of two groups share one carburetor 10 for high and low loads which communicates with all the cylinders through the suction conduit means and the branch conduit means. The throat diameter of the Venturi pipe of the carburetor 10 can be varied by means of a throat diameter varying means such as a piston (not shown). The carburetor 10 functions to deliver fuel-air mixtures to all the cylinders as indicated by broken line arrows at low loads, and to two of the four cylinders as indicated by solid line arrows at high loads. In this embodiment, the suction conduit means have a slightly greater length than those in other embodiments, so that the throat diameter of the Venturi tube of the carburetor 10 can be increased in accordance with the resistance offered to the air flowing into the suction conduit means. The features of the embodiment shown in FIG. 5 offers the advantage of being able to reduce the number of the carburetors.

A fuel-air mixture feed device for a engine having other number of cylinders, for example two cylinders or three cylinders, can be constructed similarly to the aforementioned embodiments.

From the foregoing description, it will be appreciated that the suction conduit having branch conduit connecting the cylinders to the associated carburetors is maintained at a negative pressure state at all times by the cylinders at low loads, and it is the carburetors for high and low loads only that are rendered operative at low loads. By these features, the negative pressure in the main conduit and branch conduit immediately rises when either one of the cylinders is brought to a suction stroke position. This enables air flow of a sufficiently high velocity to satisfactorily vaporize a fuel to be obtained. This is conducive to increased stability of performance of the engine at low loads.

In case there is provided only one carburetor for high and low loads for the cylinders of the two groups, the interior of the suction conduit means can be maintained at a negative pressure at all times due to the delivery of a fuel-air mixture to any one of the cylinders. Thus, it is possible to obtain a sufficiently high velocity of air flow through the carburetor for high and low loads to enable satisfactory vaporization of a fuel to be achieved in conformity with the suction stroke of each cylinder.

The fuel-air mixture feed device of the type provided by this invention is simple in construction and can achieve the same effect as a fuel-air mixture feed device of the compound carburetor type of the prior art more successfully.

What we claim is:

1. A fuel-air mixture induction system for use with a multiple cylinder internal combustion engine, each of said cylinders having an intake port and an exhaust port, the improvement comprising a plurality of carburetors wherein the number of carburetors is equal to the number of cylinders of said engine, each of said carburetors having a variable throat, a main intake conduit interconnecting said variable throat of one carburetor with the intake port of one of said cylinders, a branch conduit coupling at least a pair of said main conduits into communication, means operatively connected to said carburetors for rendering said carburetors operative for feeding a fuel air mixture to their respective corresponding cylinders during both high and low load operation of said engine, and means for directing the fuel air mixture to said branch connected main conduits during low load operation only, and an operating means coupled to said last two mentioned means for simultaneously and proportionally controlling the operation of said respective last two mentioned means whereby the optimum fuel-air mixture is introduced into the respective cylinders in accordance to the operating load imposed on the engine so that during high load operation, the fuel-air mixture is supplied directly through the main conduits interconnected between the respective carburetors and corresponding connected cylinders, and during low load operation, the fuel-air mixture is supplied through the carburetors supplying said branch connected main conduits, said first-mentioned means being operatively connected to each of said carburetors for varying the throat thereof a corresponding amount, sand said second means comprising a valve means disposed in certain of said main conduits, and said operating means being connected to said first means and said valve means for proportionally controlling said first means and valve means so that said first means is rendered operative during both low and high engine loads and said valve means is closed at low engine loads.

* * * * *